US012345277B2

(12) United States Patent
Horler et al.

(10) Patent No.: US 12,345,277 B2
(45) Date of Patent: Jul. 1, 2025

(54) ROTOR ASSEMBLY FOR A TURBOMOLECULAR PUMP

(71) Applicant: Edwards S.R.O., Lutin (CZ)

(72) Inventors: Richard Glyn Horler, Burgess Hill (GB); Ales Kubis, Lutin (CZ); David Student, Lutin (CZ)

(73) Assignee: Edwards S.R.O., Olomouc (CZ)

( * ) Notice: Subject to any disclaimer, the term of this patent is extended or adjusted under 35 U.S.C. 154(b) by 0 days.

(21) Appl. No.: 18/254,066

(22) PCT Filed: Nov. 23, 2021

(86) PCT No.: PCT/EP2021/082602
§ 371 (c)(1),
(2) Date: May 23, 2023

(87) PCT Pub. No.: WO2022/112212
PCT Pub. Date: Jun. 2, 2022

(65) Prior Publication Data

US 2024/0093701 A1 Mar. 21, 2024

(30) Foreign Application Priority Data

Nov. 25, 2020 (GB) ..... 2018530

(51) Int. Cl.
*F04D 29/66* (2006.01)
*F04D 19/04* (2006.01)
(Continued)

(52) U.S. Cl.
CPC ..... *F04D 29/662* (2013.01); *F04D 19/042* (2013.01); *F04D 19/048* (2013.01);
(Continued)

(58) Field of Classification Search
CPC ..... F04D 19/042; F04D 19/048; F04D 29/60; F04D 29/662
See application file for complete search history.

(56) References Cited

U.S. PATENT DOCUMENTS 9,869,319 B2 1/2018 Mekota et al.
2007/0031270 A1* 2/2007 Maejima ..... F04D 19/042 417/423.4
(Continued)

FOREIGN PATENT DOCUMENTS

EP 3447299 A1 * 2/2019 ..... F04D 19/042
GB 2578899 A 6/2020
(Continued)

OTHER PUBLICATIONS

British Search Report dated Apr. 13, 2021 for corresponding British application Serial No. GB2018530.2, 1 page.
(Continued)

*Primary Examiner* — Nathaniel E Wiehe
*Assistant Examiner* — Jackson N Gillenwaters
(74) *Attorney, Agent, or Firm* — Theodore M. Magee; Westman, Champlin & Koehler, P.A.

(57) ABSTRACT

The present disclosure relates to a rotor assembly 102 for a turbomolecular pump 100. The rotor assembly 102 comprises a rotor shaft 116, a plurality of rotor blades 126 extending from the rotor shaft 116, and a balancing member 130 fitted within the rotor shaft 116 with an interference fit. The rotor shaft 116 extends along a longitudinal axis 122 about which the rotor assembly 102 is configured to rotate. The interference fit is such that the balancing member 130 is retained in compression by the rotor assembly 102. The present disclosure also relates to a turbomolecular pump 100 including the rotor assembly 102 and a method of assembling a rotor assembly 102 for the same.

12 Claims, 4 Drawing Sheets

(51) Int. Cl.

| | |
|---|---|
| ***F04D 29/058*** | (2006.01) |
| ***F04D 29/32*** | (2006.01) |
| ***F04D 29/64*** | (2006.01) |

(52) U.S. Cl.
CPC ..... *F04D 29/058* (2013.01); *F04D 29/321* (2013.01); *F04D 29/644* (2013.01)

(56) References Cited

U.S. PATENT DOCUMENTS

| | | | |
|---|---|---|---|
| 2015/0063993 | A1 | 3/2015 | Tsutsui |
| 2018/0058478 | A1 | 3/2018 | Kimura |
| 2019/0055949 | A1 | 2/2019 | Watanabe |
| 2020/0116155 | A1 | 4/2020 | Nishimura |

FOREIGN PATENT DOCUMENTS

| | | | |
|---|---|---|---|
| JP | H05321879 | A | 12/1993 |
| JP | 2005163613 | A | 6/2005 |
| JP | 2007224924 | A | 9/2007 |
| JP | 2010121503 | A | 6/2010 |
| JP | 2012041857 | A | 3/2012 |
| JP | 2013145054 | A | 7/2013 |
| JP | 2015025453 | A | 2/2015 |
| JP | 2020063680 | A | 4/2020 |
| JP | 2020122487 | A | 8/2020 |
| WO | 2005121561 | A1 | 12/2005 |

OTHER PUBLICATIONS

Response dated Sep. 16, 2022 for corresponding PCT application Serial No. PCT/EP2021/082602, 3 pages.

Notification of Transmittal of the International Search Report and the Written Opinion of the International Searching Authority, or the Declaration and PCT Search Report dated Feb. 16, 2022 for corresponding PCT application Serial No. PCT/EP2021/082602, 6 pages.

PCT Written Opinion dated Feb. 16, 2022 for corresponding PCT application Serial No. PCT/EP2021/082602, 8 pages.

PCT Written Opinion dated Oct. 13, 2022 for corresponding PCT application Serial No. PCT/EP2021/082602, 19 pages.

Japanese Notification of Reason for Rejection dated Apr. 8, 2024 for corresponding Japanese application Serial No. JP2023-532176, 3 pages.

* cited by examiner

ROTOR ASSEMBLY FOR A TURBOMOLECULAR PUMP

CROSS-REFERENCE OF RELATED APPLICATION

This application is a Section 371 National Stage Application of International Application No. PCT/EP2021/082602, filed Nov. 23, 2021, and published as WO 2022/112212 A1 on Jun. 2, 2022, the content of which is hereby incorporated by reference in its entirety and which claims priority of British Application No. 2018530.2, filed Nov. 25, 2020.

FIELD

This disclosure relates to a rotor assembly for a turbomolecular pump. This disclosure also relates to a turbomolecular pump including the rotor assembly, and a method of assembling a rotor assembly for a turbomolecular pump.

BACKGROUND

A turbomolecular pump (or 'turbo pump'), is a type of vacuum pump that uses rapidly rotating rotor blades co-operating with stator vanes to create a vacuum. The rotor blades rotate on a rotor shaft (forming a rotor assembly) that is driven by a motor. As the rotor blades spin they 'hit' and 'push' gas molecules from an inlet of the pump towards an exhaust in order to create or maintain a vacuum in a particular system or space.

As will be appreciated by the skilled person, in a turbomolecular pump, a turbo stage (formed by the rotor blades and stator vanes) can be used in tandem with other rotor driven pump stages (for example, drag pump stages such as Holweck, Gaede or Siegbahn pump stages, and/or regenerative pump stages) to achieve a desired degree of vacuum and pump efficiency.

In known turbomolecular pumps, the rotor shaft is (at least in part) supported by a magnetic bearing. The magnetic bearing comprises pairs of rotating and static magnets. The static magnets are supported on a central stator and the rotating magnets surround the static magnets and are fixed against the rotor shaft. The rotating magnets support the rotor shaft and reduce the friction between the rotor shaft and the central stator by using magnetic repulsion from the static magnets to keep them spaced apart. The magnetic bearing is generally used in a turbomolecular pump as it prevents the need for a bearing that requires a lubrication compound or fluid that could potentially contaminate the vacuum environment.

In order to generate the desired levels of vacuum, the rotor assembly can be required to rotate at high speeds (e.g. between 20,000 to 90,000 revolutions per minute (RPM)). The high rotational speeds of the rotor assembly during operation can result in it being subjected to large centrifugal forces that can generate high stresses in the rotor assembly. The rotor assembly will typically have some degree of 'unbalance' around its axis of rotation (e.g., mass imbalance due to manufacturing tolerances and inconsistencies in manufacture or components mounted thereto). Under the large centrifugal forces of operation this unbalance can produce harmful high stresses and loading in the rotor assembly (e.g., in the rotor blades and rotor shaft and/or on the bearings supporting them in position). These harmful high stresses may undesirably lead to a reduction in rotor assembly life and sudden or premature failure of the rotor assembly and the pump. To minimise the effects of these high rotational and centrifugal forces on the rotor assembly, it is desirable to minimise the degree of 'unbalance' in the rotor assembly.

It is known to minimise the degree of 'unbalance' in the rotor assembly by either adding or removing mass from the rotor assembly at particular 'balance planes' within the rotor assembly. As will be appreciated by the skilled person, there may be one or more balance planes associated with a particular rotor assembly and their number and location will vary depending on a particular design or application.

It is preferable to balance the rotor by adding mass to maintain a clean environment, rather than via mass removal which can generate burrs or contamination within the pump. For example, it is known to add balance screws to holes (e.g. by co-operative threading) in the rotor shaft at such a 'balance plane' in order to add balancing weight to the rotor shaft.

Such known turbomolecular pumps are disclosed, for instance, in U.S. Pat. No. 9,869,319 and US 2020/0116155.

These known methods of balance correction for turbo pump rotor assemblies generally require extra components to be added to the rotor assembly, and an overall higher number of parts can increase manufacturing costs, time and complexity for the turbo pump.

Moreover, it has been found that known balancing methods can nonetheless fail themselves in response to the high rotor assembly speeds and local stresses generated thereby. Such failure can ultimately lead to damage and failure of the rotor assembly and pump. For example, a problem with using balance holes (e.g., that receive balance screws) is that the form and shape of the balance hole can cause local stress to increase around the balance plane in response to the high rotational and centrifugal forces generated by the rotor assembly. This increased local stress at the balance holes during use can cause the material at the balance plane to yield and fail (e.g., via fatigue failure due to repeated exposure to high local stress conditions around the holes over time). Accordingly, a need exists to improve the durability of the balancing device employed in such turbomolecular pumps, as well as reducing overall part count and cost.

The discussion above is merely provided for general background information and is not intended to be used as an aid in determining the scope of the claimed subject matter. The claimed subject matter is not limited to implementations that solve any or all disadvantages noted in the background.

SUMMARY

From one aspect, the present disclosure provides a rotor assembly for a turbomolecular pump. The rotor assembly comprises a rotor shaft, a plurality of rotor blades extending from the rotor shaft and a balancing member fitted within the rotor shaft with an interference fit. The rotor shaft extends along a longitudinal axis about which the rotor assembly is configured to rotate, and the interference fit is such that the balancing member is retained in compression by the rotor assembly.

By 'within' the shaft, it is meant that the balancing member is retained radially within the outer circumference of the rotor shaft.

The interference fit of the balancing member within the rotor shaft retains the balancing member in compression in order to reduce or prevent dilation (i.e., expansion) of the balancing member during rotation of rotor assembly. This can reduce the local stresses experienced in the balancing member during operation of the pump. This can improve the durability and operational lifetime of the balancing member and reduce its failure rate.

In an embodiment of the above, the rotor shaft defines a circumferentially-extending inner shaft surface and the balancing member defines a circumferentially-extending outer surface. The interference fit is between the inner shaft surface and the outer surface.

In this manner, the circumferentially-extending inner shaft surface compresses the circumferentially-extending outer surface of the balancing member. This provides a consistent interference fit and compression around the outer surface of the balancing member.

In a further embodiment of the above, the balancing member is generally annular, defining a central bore, a radially-extending front surface and an opposing radially-extending rear surface extending between the central bore and the circumferentially-extending outer surface.

In a further embodiment of any of the above, a chamfered surface extends between the circumferentially-extending outer surface and the radially-extending rear surface. The chamfered surface is planar surface that extends from the outer surface to the rear surface at a radially inward angle relative to the longitudinal axis. The angle can be any suitable acute angle, for example, 45°.

The optional chamfered surface can help the radially-extending rear surface of the balancing member avoid contact with the inner shaft surface and provide firmer retaining contact with the at least one magnet.

In a further embodiment of any of the above, wherein the balancing member includes at least one balancing feature defined therein.

A 'balancing feature' is any feature added to or defined in the balancing member that can be used to help 'fine-tune' the rotational balance of the rotor assembly, for example, by either adding or removing weight from the balancing member.

In one embodiment, the radially-extending front surface (i.e., the front axial face) of the balancing member includes a plurality of balancing features in the form of a plurality of holes defined therein for receiving balance weights. The plurality of holes may be evenly spaced around the circumference of the balancing member, and may be threaded to receive a co-operatively threaded balance weight (e.g., a balance screw).

In a further embodiment of any of the above, the rotor assembly further comprises at least one magnet mounted to the rotor shaft for rotation therewith.

The at least one magnet can be used to form a magnetic bearing for the supporting the rotor assembly when used in a turbomolecular pump.

In a further embodiment of the above, the balancing member is positioned to axially retain the at least one magnet to the rotor shaft.

In this manner, the balancing member removes the need for a separate magnet retaining component and thus reduces the number of components, simplifies the assembly and reduces manufacturing costs.

In a further embodiment of either of the above, the balancing member axially abuts the at least one magnet.

In this manner, the balancing member contacts the at least one magnet to retain it in the axial direction (i.e., along the longitudinal axis), and prevent axial movement of the magnet. This helps keep the magnetic bearing formed by the at least one magnet stable during operation. The balancing member retaining the at least one magnet also helps protect it during assembly and operation.

In a further embodiment of any of the above, the at least one magnet is mounted to the circumferentially-extending inner shaft surface by an interference fit.

The interference fit may help improve the retention of the at least one magnet within the shaft to prevent its movement during operation, and apply compression to the at least one magnet to improve its durability.

In a further embodiment of any of the above, the balancing member is fitted within a recess defined by the circumferentially-extending inner shaft surface. In other words, the inner shaft surface comprises a recess within which the balancing member is fitted. In one embodiment, the recess is an annular recess that extends circumferentially around the longitudinal axis and forms an annular shoulder defining a radially-extending surface.

Fitment of the balancing member in the recess helps provide more secure retention of the balancing member, and facilitates correct and stable assembly of the balancing member within the rotor assembly.

In a further embodiment of the above, the balancing member is fitted with the interference fit within the annular recess and comprises the radially-extending rear surface that axially abuts the at least one magnet, and a gap is formed between the radially-extending surface of the annular shoulder and the radially-extending rear surface of the balancing member.

The gap means that the radially-extending rear surface of the balancing member provides firmer retaining contact with the at least one magnet, without the radially-extending surface of the annular shoulder reducing such contact.

From another aspect, the present disclosure provides a turbomolecular pump. The turbomolecular pump comprises the rotor assembly of the above aspect or any of its embodiments and a motor to drive the rotor assembly to rotate.

The turbomolecular pump including the rotor assembly has improved durability, operational lifetime and vibrational characteristics owing to the balancing member's implementation therein.

In a further embodiment, the pump further comprises a central stator assembly to support the rotor assembly. In embodiments where the rotor assembly comprises at least one magnet, the central stator assembly includes a corresponding stator magnet(s) that are statically fixed thereto, which forms a magnetic bearing with the at least one magnet of the rotor assembly.

In a further embodiment of either of the above, the pump further comprises an outer casing that houses the rotor assembly, motor and (in embodiments where it is included) the central stator assembly.

In a further embodiment of the above, the outer casing includes stator vanes that are supported by the outer casing, and which are positioned to provide a stator stage upstream and/or downstream of the rotor blades. The rotor blades and/or stator vanes form a turbo stage for the pump.

In yet a further embodiment of the above, the pump further comprises a drag pump stage downstream of the turbo stage. The drag pump stage can be any suitable drag pump stage such as a Holweck, Gaede or Siegbahn pump stage.

In yet a further embodiment of the above, the pump further comprises a regenerative pump stage downstream of the drag pump stage.

From another aspect, the present disclosure provides a method of assembling a rotor assembly for a turbomolecular pump. The method comprises fitting a balancing member within a rotor shaft with an interference fit. The rotor shaft extends along a longitudinal axis about which the rotor assembly is configured to rotate, and a plurality of rotor blades extend from the rotor shaft.

In a further embodiment of the above, the method further comprises heating the rotor shaft to thermally expand the rotor shaft; cooling the balancing member to thermally contract the balancing member; pressing the contracted balancing member into the expanded rotor shaft; and allowing the rotor shaft and the balancing member to equalise in temperature such that the rotor shaft thermally contracts and the balancing member thermally expands to form the interference fit.

By 'equalise' in temperature it is meant that the heating and cooling processes on the rotor shaft and the balancing member (respectively) are stopped and the rotor shaft and balancing member are allowed to return to ambient temperature.

Using this method can ensure a higher degree of interference (i.e., a larger interference fit) is achieved between the rotor shaft and the balancing member (e.g., compared to simply pressing fitting them together at ambient temperatures). This can help ensure the balancing member remains retained in place under the high rotational speed conditions used during operation.

In a further embodiment of the above, the method further comprises fitting at least one magnet within the rotor shaft before fitting the balancing member. The at least one magnet may be interference fit within the rotor shaft.

By fitting the at least one magnet before the balancing member, the balancing member can have the dual function of providing rotational balancing for the rotor assembly, as well as acting as the retention means for the at least one magnet. This may reduce part count and reduce manufacturing complexity and costs.

In further embodiments, the method can be used to assemble a rotor assembly having any of the features discussed in the above aspect thereof or any of its embodiments.

Although certain advantages have been discussed in relation to certain features above, other advantages of certain features may become apparent to the skilled person following the present disclosure.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

BRIEF DESCRIPTION OF DRAWINGS

One or more non-limiting examples will now be described, by way of example only, and with reference to the accompanying figures in which.

DETAILED DESCRIPTION

Figure 1:
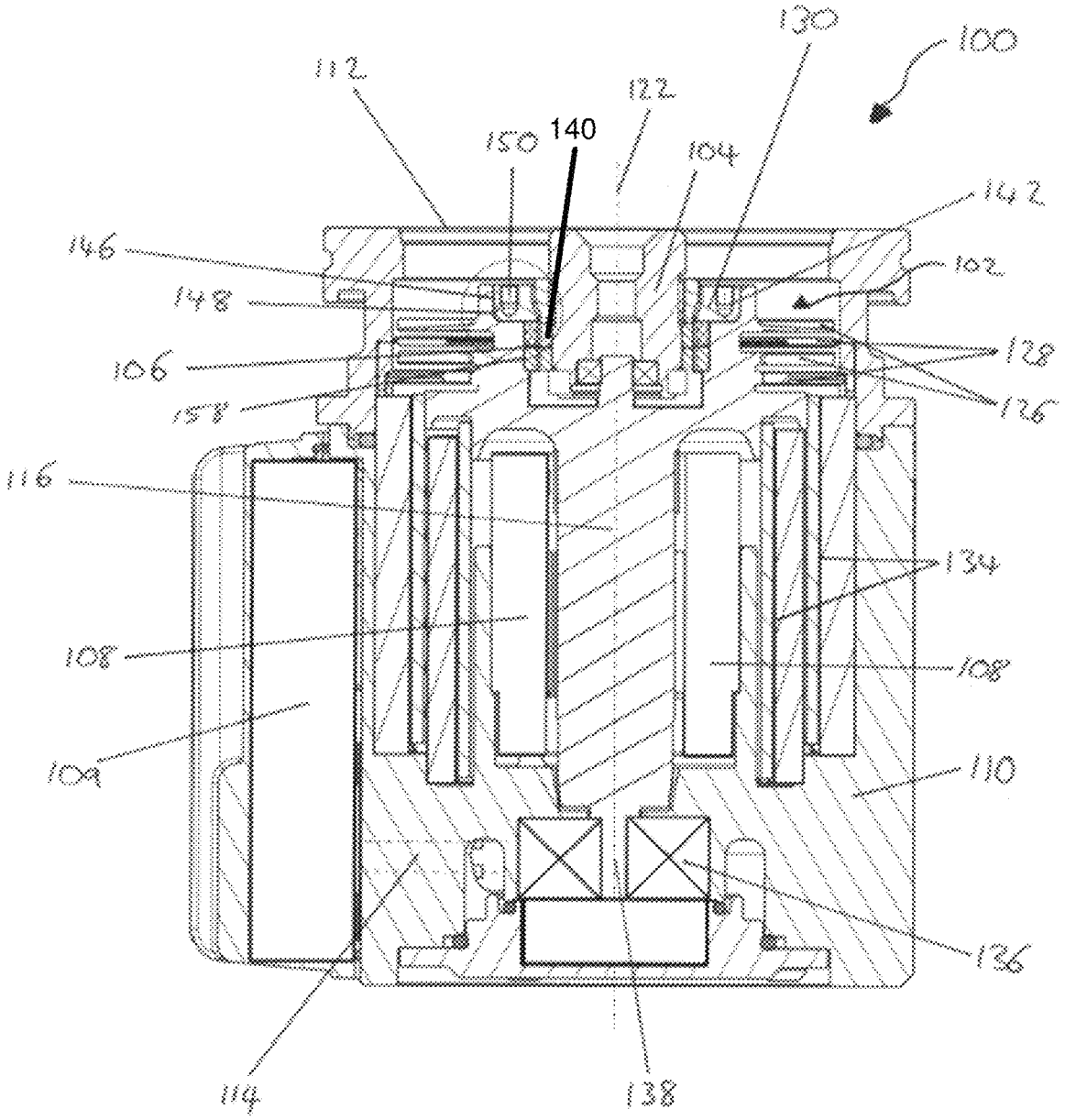
FIG. 1 shows a cross-sectional view of a turbomolecular pump including a rotor assembly in accordance with an embodiment of the present disclosure.

Referring to FIG. 1, a turbomolecular pump 100 is shown in accordance with an embodiment of the present disclosure. The turbomolecular pump 100 comprises a rotor assembly 102 supported by a central stator assembly 104 with a magnetic bearing 106 and a motor 108 for driving the rotor assembly 102. The rotor assembly 102, central stator assembly 104 and motor 108 may be housed within an outer casing 110. The outer casing 110 defines a gas inlet 112 and a gas outlet (not visible in this particular cross-section). The motor 108 is controlled by control electronics 109, which communicate with motor 108 by wires or other suitable electrical connections that pass through an electronics passage 114 (shown in phantom) defined in the outer casing 110.

Figure 2:
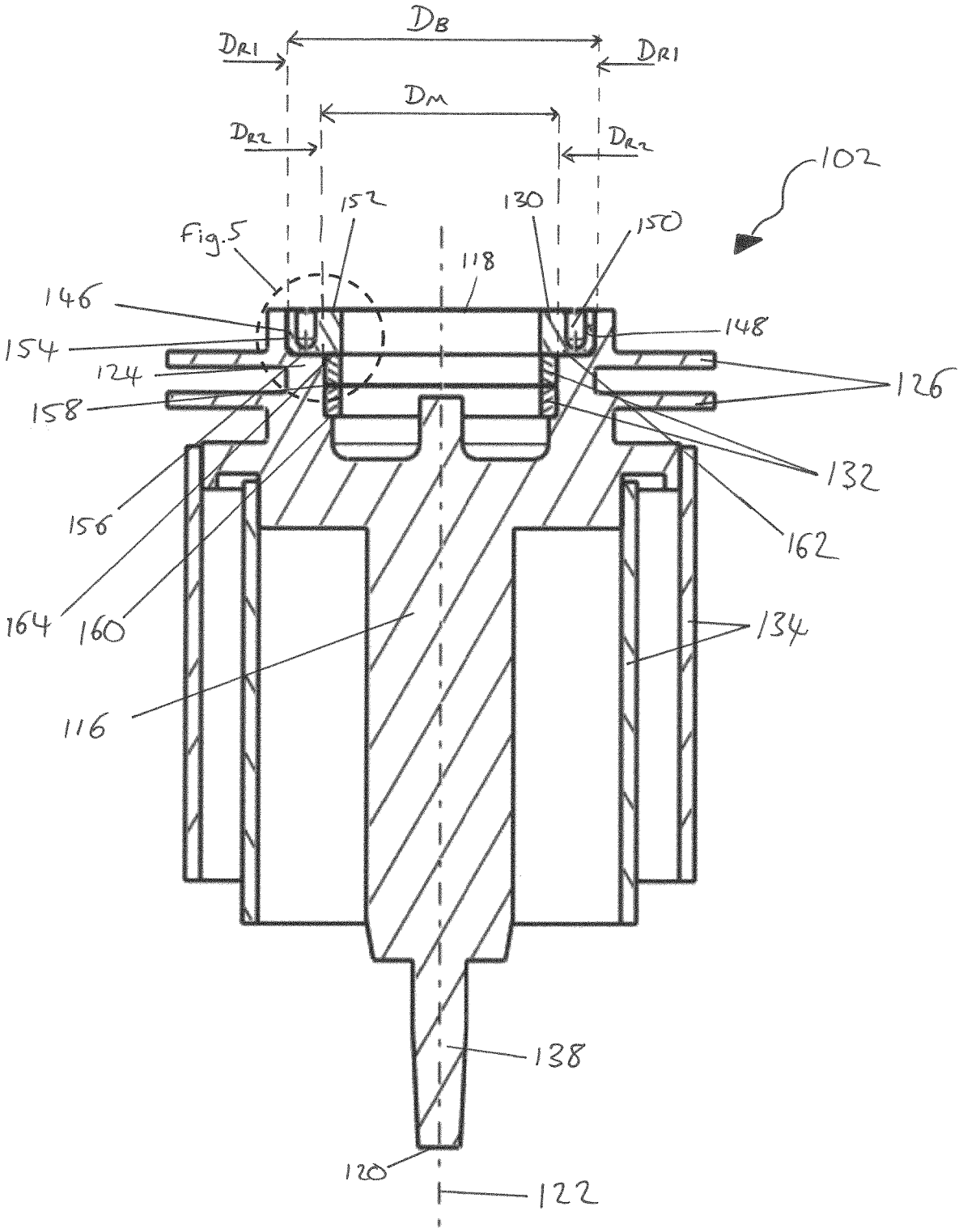
FIG. 2 shows a cross-sectional view of the rotor assembly of FIG. 1 in accordance with an embodiment of the present disclosure.

FIG. 2 shows the rotor assembly 102 on its own, in accordance with an embodiment of the present disclosure. The rotor assembly 102 comprises a rotor shaft 116 extending from a first end 118 to a second end 120 along a longitudinal axis 122 about which the rotor assembly 102 is configured to rotate. In other words, the longitudinal axis 122 is the rotational axis of the rotor assembly 102.

The rotor shaft 116 comprises a hub 124 at the first end 118 from which a plurality of rotor blades 126 extend. The rotor blades 126 may be integrally formed with the rotor shaft 116, or formed separately and attached thereto by any suitable means. The rotor blades 126 are arranged in stages, which alternate with stages of stator vanes 128 that are supported by the outer casing 110 when the rotor assembly 102 is assembled in the turbomolecular pump 100 as shown in FIG. 1.

In embodiments, the rotor assembly 102 may also comprise molecular drag pump stages. For example, in the depicted embodiment Holweck stages 134 are arranged downstream of the rotor blades 126 to increase the amount of gas/molecules expelled from the pump 100.

With reference to both FIGS. 1 and 2, to create or maintain a vacuum the motor 108 drives the rotor assembly 102 including the rotor blades 126 to rotate about the longitudinal axis 122. The rotating blades 126 of the rotor assembly 102 co-operate with the stator vanes 128 to drive gas molecules from the gas inlet 112 through the pump 100 to the Holweck stages 134. The Holweck stages 134 then act to help pump the gas molecules to the gas outlet downstream thereof for expulsion from the pump 100.

As shown in FIGS. 1 and 2, the rotor assembly 102 is assembled within the turbomolecular pump 100 with the first end 118 of the rotor shaft 116 at the gas inlet 112 and the second end of the rotor shaft 116 opposite it along the longitudinal axis 122. The first end 118 of the rotor shaft 116 is supported by the magnetic bearing 106 and the second end 120 is supported by a mechanical bearing 136.

The mechanical bearing 136 can be any suitable type of bearing, such as a deep groove or angular contact bearing. Other possible examples include ball bearings or roller bearings.

In the depicted embodiment, the rotor assembly 102 also comprises a stub shaft 138 at end 120 that is used to join the rotor shaft 116 to the mechanical bearing 136. However, within the scope of this disclosure, any other suitable means of supporting and/or joining the rotor shaft 116 may be used.

The magnetic bearing 106 is provided between the hub 124 and the central stator assembly 104 with the rotor magnets 132 mounted in the hub 124.

To form the magnetic bearing 106, stator magnets 140 are mounted on the central stator assembly 104 which is received within the hub 124 so that a radial repulsive force is provided between the rotor magnets 132 and the stator magnets 140.

In the depicted embodiment, there are two annular stator magnets 140 mounted to the central stator assembly 104 and two corresponding annular rotor magnets 132 mounted to hub 124. However, it will be understood there can be any suitable numbers of stator magnets 140 and rotor magnets 132 as may be necessary for a particular application. For example, there may be more or less than two stator and rotor magnets 140, 132. More generally, there is at least one rotor magnet 132 and at least one corresponding stator magnet 140.

The annular stator and rotor magnets 132, 140 are arranged coaxially about the longitudinal axis 122, with the stator magnets 140 arranged concentrically within the rotor magnets 132 to provide the radial repulsive force between them.

As illustrated in FIG. 1, the rotor magnets 132 may be slightly axially offset from the stator magnets 140 to provide an axial repulsive force between the magnets 132, 140 to pre-load the mechanical bearing 136 at the second end 120 of the rotor shaft 116.

In this manner, the magnetic bearing 106 provides support for the rotor shaft 116 and centralises the rotor shaft 116 within the pump 100 while reducing friction through the magnetic repulsion between the rotor magnets 132 and stator magnets 140 as the shaft 116 rotates.

Using the magnetic bearing 106 at the first end of the shaft 116 as opposed to a mechanical bearing avoids the need for a lubrication compound or fluid that could potentially contaminate the vacuum environment. Nonetheless, within the scope of this disclosure, other embodiments could employ a second mechanical bearing (e.g., similar to first mechanical bearing 136) instead of the magnetic bearing 106. Such embodiments could have cost and assembly benefits, as it avoids the need for potentially more expensive and fragile magnetic materials to be used.

As discussed above, it is advantageous to balance the rotor assembly 102 at a balance plane. A balance plane may be provided by the addition of balance screws at various points along the rotor shaft 116. There may be a plurality of balance planes provided for the rotor assembly 102. For example, the rotor assembly 102 may comprise a first balance plane 142 at the first end 118 of the rotor shaft, a second balance plane (not shown) at the second end 120 of the rotor shaft 116, and a third balance plane (not shown) intermediate the first and second balance planes. It will be understood that the number of balance planes required will vary depending on the particular application and the amount of residual 'unbalance' in the rotor assembly deemed acceptable for pump operation in that application.

In the embodiment of FIGS. 1 and 2, the rotor assembly 102 comprises at least one balance plane 142 at the first end 118 of the rotor shaft 116. This balance plane 142 is provided by the addition of a balancing member 130 fitted within the rotor shaft 116 by an interference fit. In other words, the balancing member 130 is retained radially within the outer circumference of the rotor shaft 116 by an interference fit therewith.

In particular, as depicted, the balancing member 130 is fitted within the rotor shaft 116 with an interference fit inside the hub 124. As discussed in more detail below, the balancing member 130 can be used to provide rotational balance correction/compensation for the rotor assembly 102, and additionally retain the rotor magnets 132 that are fitted inside the hub 124 for forming the magnetic bearing 106.

The interference fit of the balancing member 130 within the rotor shaft 116 retains the balancing member in compression in order to reduce or prevent dilation (i.e., expansion) of the balancing member 130 during rotation of rotor assembly 102. This can reduce local stresses experienced in the balancing member 130 during operation of the pump 100. This can improve the durability and lifetime of the balancing member 130, and reduce its failure rate.

Figure 3:
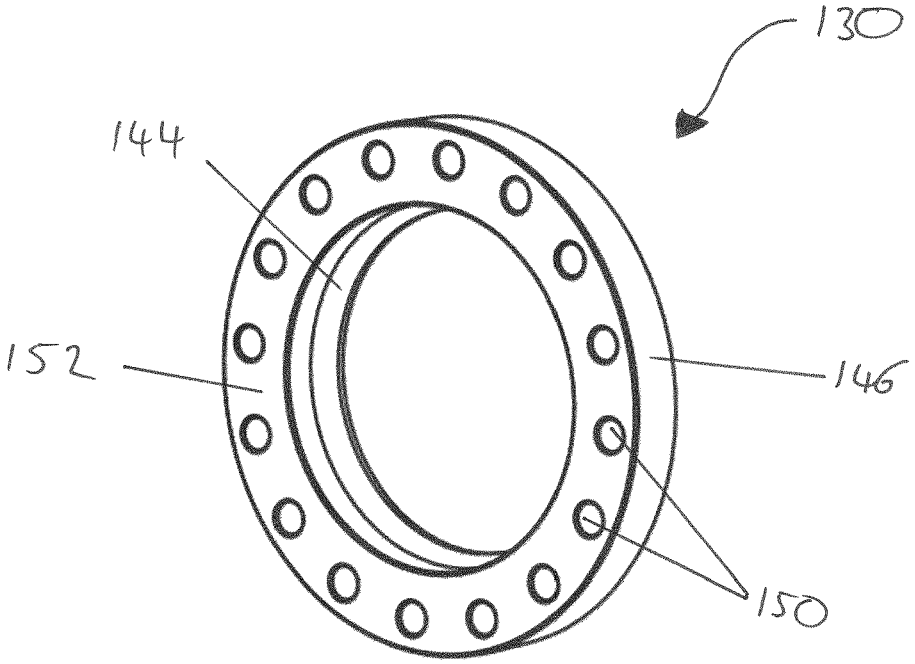
FIG. 3 shows a perspective view of a balance ring for use in the rotor assembly of FIG. 2.
Figure 4:
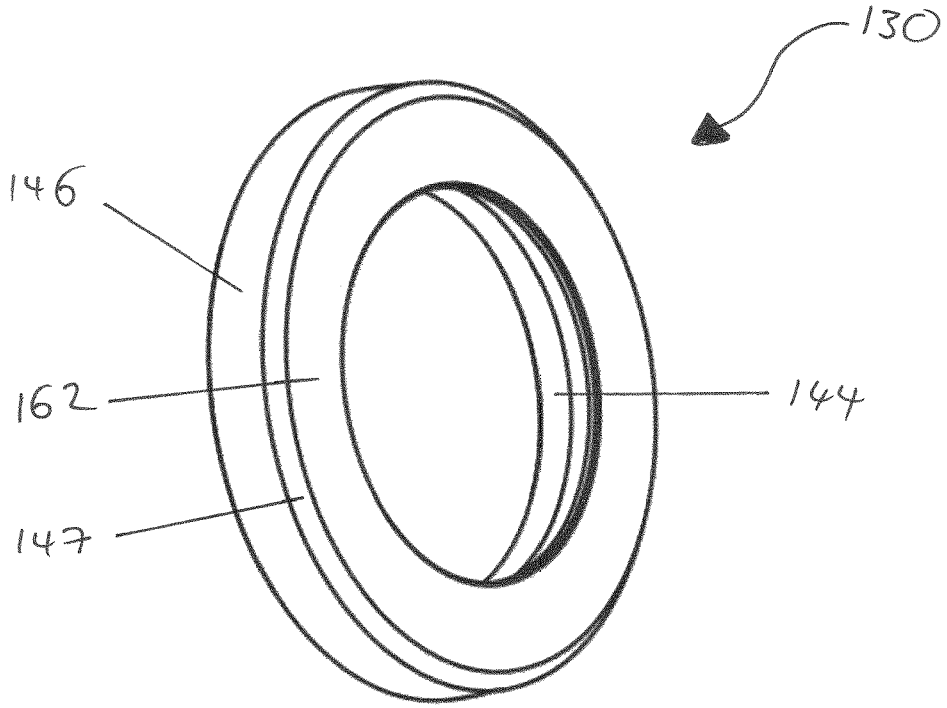
FIG. 4 shows another perspective view of the balance ring of FIG. 3.
Figure 5:
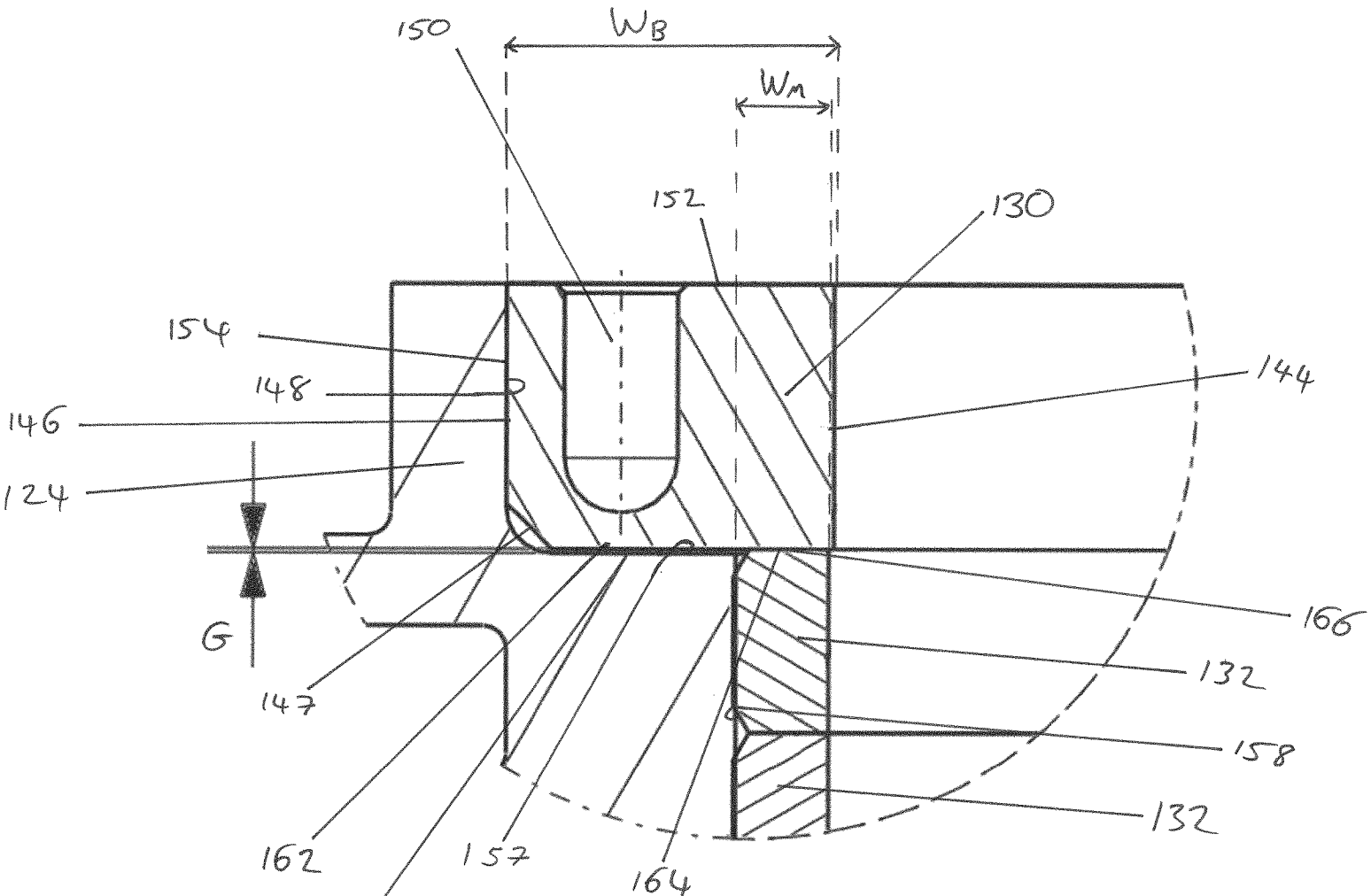
FIG. 5 shows a close-up view of part of the rotor assembly of FIG. 2.

With further reference to FIGS. 3 to 5, the balancing member 130 is generally annular, and forms a balance ring 130 defining a central bore 144 and a circumferentially-extending outer surface 146. However, it should be understood that the balancing member 130 is not limited to a ring and may be provided in any other suitable form or shape, e.g. any generally annular or axisymmetric shape.

The rotor shaft 116 defines a circumferentially-extending inner shaft surface 148 within the hub 124, and the interference fit is between the inner shaft surface 148 and the balancing member outer surface 146. The interference fit between the inner shaft surface 148 and the balancing member outer surface 146 is such that the balance ring 130 is retained in compression by the rotor shaft 116 to reduce or prevent dilation (e.g., expansion) of the balance ring 130 as the rotor assembly 102 rotates.

The interference fit is to be sufficiently high to retain the balancing ring 130 in place under the high maximum operational speeds of the rotor assembly 100 and loads generated thereby.

In one example, a suitable degree of interference fit is 100-70 μm or around 85 μm (e.g., 85 μm+/−15 μm). However, it will be understood that within the scope of this disclosure, the degree of interference between the balance ring 130 and the rotor shaft 116 can be varied to any other suitable value depending on the particular application and operational speeds thereof.

The balance ring 130 comprises a balancing feature, in the form of holes 150 formed in a radially-extending front surface 152 for receiving balance screws (not shown). Holes 150 may be threaded, such that balance screws can be screwed into the holes 150 to add an amount of weight to the balance ring 130, as may or may not be necessary to fine-tune the rotational balance of the rotor assembly 102.

In the depicted embodiment, there are 16 holes 150 evenly spaced around the circumference of the balance ring 130 (i.e., each of the holes 150 are spaced 22.5 degrees apart from the next hole 150 around the circumference of the balance ring 130). However, within the scope of this disclosure, any suitable number and/or spacing (even or uneven) of holes 150 can be used, as may be required to provide the necessary fine-tuning for a particular application.

Moreover, although the balance ring 130 depicts holes 150 for receiving balance weights as a balancing feature, the scope of this disclosure extends to any other suitable balancing feature.

For example, the balance ring 130 may be shaped or internally weighted or machined (e.g., by laser ablation) to remove weight therefrom in specific areas to provide the rotational balancing. Moreover, instead of adding balance weights into holes 150, the holes 150 could be omitted and the balance ring 130 could instead feature small amounts of glue or adhesive added thereto to add weight. Furthermore, the balance ring 130 alone may be sufficient to provide the rotational balancing without a specific additional balancing feature.

Accordingly, the present disclosure extends to include any suitable configuration of a balancing member and/or balancing features that can provide rotational balancing as discussed above.

In the depicted embodiment, the rotor shaft 116 defines a first recess 154 in the circumferentially-extending inner shaft surface 146 of the hub 124 for receiving the balance ring 130. The first recess 154 is an annular recess that extends circumferentially around the longitudinal axis 122 and forms a first annular shoulder 156 defining a radially-extending surface 157 within the first recess 154.

The balance ring 130 is fitted within the first annular recess 154 adjacent to the first annular shoulder 156. The placement of the balance ring 130 in the recess 154 adjacent shoulder 156 may improve the security of the fitment between the balance ring 130 and the rotor assembly 102, as well as facilitate the assembly of the balance ring 130 within the rotor shaft 116.

Nonetheless, it should be understood that in other embodiments within the scope of this disclosure, the balance ring 130 need not be retained in recess 154. For example, the balance ring 130 could instead be interference fit flush against a radially inner surface of the hub 124 without a recess (or corresponding shoulder) being present therein.

The rotor assembly 102 and its individual components (e.g. rotor shaft 116 and balancing ring 130) can be made of any suitable material or combination of materials, such as metal alloys. In one particular example, the rotor assembly 102 including rotor shaft 116 and balancing ring 130 are made of an aluminium alloy such as AA7075). Aluminium alloys are advantageous compared to other suitable metal materials, such as stainless steels, due to their relative lightweight and sufficient mechanical properties and corrosion resistance for turbo pump applications.

In addition to providing an improved balancing member that is more durable, the depicted balance ring 130 is also positioned to provide the function of a retaining member (i.e., a retaining ring) for the rotor magnets 132.

Integrating the balancing and magnet retaining functions in a single component removes the need for a separate magnet retaining ring and thus reduces the number of components, simplifies the assembly and reduces manufacturing costs.

In the depicted embodiments, the rotor magnets 132 are rare earth magnets (such as neodymium-iron-boron or samarium-cobalt magnets), which are relatively brittle materials (e.g. compared to the rest of the rotor assembly 102) and can chip easily. It is therefore particularly advantageous to tightly retain such rotor magnets 132 using the balance ring 130 within the shaft 116 to avoid movement of the magnets 132, which could cause damage thereto when assembling or operating the pump 100. As will be appreciated, these magnets can be made from a powder material that is pressed into shape (e.g., into annular bodies) and sintered. In other examples, the rotor magnets 132 may be ceramic magnets or any other suitable magnetic material.

An interference fit is provided between the rotor magnets 132 and the rotor shaft 116 to provide additional retention of the rotor magnets 132. The interference fit of the rotor magnets 132 with the rotor shaft 116 can be to the same degree as the balance ring 130 (as discussed above), or may be higher or lower depending on the particular application and magnet materials used. For example, the interference fit needed will depend on how much retention of the magnets is required for a particular application and operational speed, and the relatively brittle rare earth magnets will be required to be held in a higher degree of compression within the rotor shaft 116 in order to avoid cracking, compared to other, more ductile magnet materials.

As shown in FIGS. 1 and 2, the rotor magnets 132 are mounted in a second annular recess 158 defined within the hub 124 at the first end 118 of the rotor shaft 116. The rotor magnets 132 are stacked on a second annular shoulder 160 formed by the second annular recess 158 and are retained between the second annular shoulder 160 and the balance ring 130. The central bore 144 of the balance ring 130 accommodates the central stator assembly 104 that carries the stator magnets 140.

As with the balance ring 130 above, it should be understood that in other embodiments within the scope of this disclosure, the rotor magnets 132 need not be retained in recess 158. For example, the rotor magnets 132 could instead be fitted flush against a radially inner surface of the hub 124 without a recess (or corresponding shoulder) being present therein.

With additional reference to FIG. 5, in the depicted embodiment the balance ring 130 axially abuts one of the rotor magnets 132 to help axially retain the rotor magnets 132 within the rotor shaft 116.

A radially-extending rear surface 162 of the balance ring 130 (opposite, and axially rearward of the radially-extending front surface 152) is in contact with a radially-extending end surface 164 of one of the rotor magnets 132.

The balance ring 130 has a greater annular width W B than the annular width W M of the rotor magnets 132, such that only a radially inner portion 166 of the radially-extending rear surface 162 of the balance ring 130 is in contact with the radially-extending end surface 164 of one of the rotor magnets 132. The rest of the radially-extending rear surface 162 of the balance ring 130, i.e., a radially outer portion, is aligned (i.e., parallel) with the first annular shoulder 156 of the first annular recess 154.

As shown in FIG. 5, the rotor magnets 132 stacked on the second annular shoulder 160 extend axially beyond the first annular shoulder 156 such that a gap G is provided between the radially-extending rear surface 162 of the balance ring 130 and the radially extending surface 157 of the first annular shoulder 154. In other words, the contact between the radially-extending rear surface 162 of the balance ring 130 and the radially-extending end surface 164 of one of the rotor magnets 132 prevents the balance ring 130 from coming into contact with the first annular shoulder 156.

To further prevent contact with the first annular shoulder 156 and thus maintain gap G, the balance ring 130 further includes a chamfered surface 147 extending between the outer surface 146 and rear surface 162. The chamfered surface 147 extends from the outer surface 146 to the rear surface 162 at a radially inward angle relative to the longitudinal axis 122. The angle can be any suitable acute angle, but in the depicted example is 45°.

The gap G is advantageous because it enables the balance ring 130 to maintain contact with the adjacent rotor magnet 132 at all times during operation. This improves the axial retention of the rotor magnets 132 to minimise distortion or damage to the magnets 132, and also maintains the positions of the rotor magnets 132 with respect to the stator magnets 140 for stable operation of the magnetic bearing 106.

In the depicted example, the gap G is about 0.1 mm (i.e., +/−0.05 mm), although may be any other suitable size that ensures the rotor magnets 132 are held firmly by the balancing ring 130 without negatively impacting the size and operation of the rotor assembly. For example, between 0.1 mm and 1 mm.

Although the above discussed positioning of the balance ring 130 at first 118 to retain the rotor magnets 132 is particularly advantageous, it should be understood that within the scope of this disclosure the balance ring 130 can be used at any other suitable position along the rotor shaft 116 (e.g., at any other suitable balancing plane) without departing from the scope of this disclosure.

For example, the balancing ring 130 could additionally or alternatively be applied at the second end 120 or an intermediate position along the rotor shaft 116. Such positioning may not benefit from the balancing ring 130 doubling as a magnet retention device, but would nonetheless allow these additional or alternative balance planes to benefit from its durability advantages.

With reference to FIG. 2, a method of assembling the rotor assembly 102 will now be described in accordance with an embodiment of the present disclosure. To assemble the rotor assembly 102 with the interference fit between the rotor shaft 116 and the balance ring 130, the rotor shaft 116 is thermally expanded and the balance ring 130 is thermally contracted to increase the difference between the outer diameter $D_B$ of the balance ring 130 and an inner diameter $D_{R1}$ of the rotor shaft 116. In the depicted embodiment, the inner diameter $D_{R1}$ of the rotor shaft 116 is the inner diameter $D_{R1}$ of the first recess 154 in the hub 124, which receives the balance ring 130.

The method of assembly therefore comprises heating the rotor shaft 116 for thermal expansion and cooling the balance ring 130 for thermal contraction. For example, the rotor shaft 116 may be heated in a furnace or an oven to a temperature in the range of 100° C. and 150° C., or more narrowly about 135° C. The balance ring 130 may be cooled using a refrigeration device or a bath of cooling fluid, such as liquid nitrogen, to a temperature in the range of [wide range], or more narrowly of around −190° C.

The cooled and thermally contracted balance ring 130 is fitted (i.e., positioned) within the heated and thermally expanded rotor shaft 116. The temperatures of the balance ring 130 and rotor shaft 116 are then allowed to equalise so that the balance ring 130 expands and the rotor shaft 116 contracts to form an interference fit between the two.

The rotor magnets 132 may be mounted to the rotor assembly 116 in a similar manner by cooling the magnets 132 so that they thermally contract to increase the difference between the outer diameter $D_M$ of the annular rotor magnets 132 and an inner diameter $D_{R2}$ of the rotor shaft 116. In the depicted embodiment, the inner diameter $D_{R2}$ of the rotor shaft 116 is the inner diameter $D_{R2}$ of the second recess 158 in the hub 124 which receives the rotor magnets 132.

The cooled and thermally contracted rotor magnets 132 are fitted (i.e., positioned) within the heated and thermally expanded rotor shaft 116 before the balance ring 130 is fitted. The temperature of the rotor magnets 132 is allowed to equalise with the temperatures of the rotor shaft 116 (and balance ring 130) so that the rotor magnets 132 thermally expand to form an interference fit with the rotor shaft 116, as it cools and contracts.

As will be understood by the skilled person, the relative diameters ($D_{R1}$, $D_B$, $D_{R2}$, $D_M$) and heating and cooling temperatures can be varied to provide a desired degree of interference and/or ease of fitment between the balance ring 130/rotor magnet 132 and the rotor shaft 116.

Moreover, in other suitable methods of assembly to form the interference fit, the rotor shaft 116 is thermal expanded sufficiently such that the balance ring 130/rotor magnet 132 can be fitted therein without the need for thermal contraction (i.e., cooling) thereof. Likewise, in yet other suitable methods of assembly to form the interference fit, the thermal contraction of the balance ring 130/rotor magnet 132 may be sufficient such that they can be fitted in the rotor shaft 116 without the need for thermal expansion (i.e., heating) thereof.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A rotor assembly for a turbomolecular pump, the rotor assembly comprising:

a rotor shaft extending along a longitudinal axis about which the rotor assembly is configured to rotate, the rotor shaft defining a circumferentially-extending inner shaft surface;

at least one magnet mounted to the rotor shaft for rotation therewith;

a plurality of rotor blades extending from the rotor shaft; and a balancing member defining a circumferentially-extending outer surface fitted within the rotor shaft such that the circumferentially-extending outer surface of the balancing member contacts the circumferentially-extending inner shaft surface to provide an interference fit between the balancing member and the rotor shaft such that the balancing member is retained in compression by the rotor shaft and the balancing member is positioned to axially retain the at least one magnet to the rotor shaft;

wherein the balancing member comprises a plurality of balancing features in the form of a plurality of holes defined therein for receiving balance weights.

2. The rotor assembly of claim 1, wherein a radially-extending front surface of said balancing member includes said plurality of holes defined therein.

3. The rotor assembly of claim 2, wherein the balancing member is generally annular, defining a central bore, a radially-extending rear surface extending between the central bore and the circumferentially-extending outer surface, and a chamfered surface extending between the circumferentially-extending outer surface and the radially-extending rear surface.

4. The rotor assembly of claim 1, wherein the balancing member axially abuts the at least one magnet.

5. The rotor assembly of claim 1, wherein the at least one magnet is mounted to the circumferentially-extending inner shaft surface by an interference fit.

6. The rotor assembly of claim 1, wherein the balancing member is fitted within a recess defined by the circumferentially-extending inner shaft surface.

7. The rotor assembly of claim 6, wherein the recess is an annular recess that extends circumferentially around the longitudinal axis and forms an annular shoulder defining a radially-extending surface.

8. The rotor assembly of claim 1, wherein:

wherein and the circumferentially-extending inner shaft surface defines an annular recess extending circumferentially around the longitudinal axis and forms an annular shoulder that defines a radially-extending surface;

the balancing member is fitted within the annular recess and comprises a radially-extending rear surface that axially abuts the at least one magnet; and a gap is formed between the radially-extending surface of the annular shoulder and the radially-extending rear surface of the balancing member.

9. A turbomolecular pump comprising the rotor assembly of claim 1; and a motor to drive the rotor assembly to rotate.

10. A method of assembling a rotor assembly for a turbomolecular pump, the method comprising fitting at least one magnet within the rotor shaft, fitting a balancing member within a rotor shaft of the rotor assembly such that a circumferentially-extending outer surface of the balancing member is in contact with a circumferentially-extending inner surface of the rotor shaft such that the contact provides an interference fit between the balancing member and the rotor shaft to axially retain the at least one magnet to the rotor shaft, the balancing member comprising a plurality of balancing features in the form of a plurality of holes defined therein for receiving balance weights, wherein the rotor shaft extends along a longitudinal axis about which the rotor assembly is configured to rotate, and a plurality of rotor blades extend from the rotor shaft.

11. The method of claim 10, wherein fitting the balancing member within the rotor shaft comprises:

heating the rotor shaft to thermally expand the rotor shaft;

cooling the balancing member to thermally contract the balancing member;

pressing the contracted balancing member into the expanded rotor shaft; and allowing the rotor shaft and the balancing member to equalise in temperature such that the rotor shaft thermally contracts and the balancing member thermally expands to form the interference fit.

12. The method of claim 11, wherein the holes are provided in a radially extending front surface of the balancing member.

* * * * *